United States Patent [19]

Ilves et al.

[11] Patent Number: 5,014,638

[45] Date of Patent: May 14, 1991

[54] MOORING CONSTRUCTION FOR A BOAT

[76] Inventors: Juhani E. Ilves, 1418 Lakeview Dr., Lake Worth, Fla. 33461; Unto A. Heikkilä, Tuurintie 1, SF 20100 Turku, Finland

[21] Appl. No.: 488,203

[22] Filed: Mar. 5, 1990

[51] Int. Cl.[5] ..... B63B 21/00

[52] U.S. Cl. ..... 114/230

[58] Field of Search ..... 114/44, 45, 219, 220, 114/230; 405/1, 211, 212, 213, 216, 218; 267/116, 139

[56] References Cited

U.S. PATENT DOCUMENTS

| | | | |
|---|---|---|---|
| 2,844,943 | 7/1958 | Kennedy | 405/213 |
| 2,996,033 | 8/1961 | Yordi | 114/230 |
| 3,196,824 | 7/1965 | Howard | 114/230 |
| 4,043,545 | 8/1977 | Dial et al. | 114/219 |
| 4,144,831 | 3/1979 | Heydolph | 114/230 |
| 4,206,717 | 6/1980 | Okuda | 114/230 |
| 4,627,375 | 12/1986 | Davis et al. | 114/230 |

*Primary Examiner*—Sherman Basinger
*Assistant Examiner*—Stephen P. Avila
*Attorney, Agent, or Firm*—Jack N. McCarthy

[57] ABSTRACT

A mooring construction having a connecting unit for connecting a boat to a dock, or similar mooring structure, where the connecting unit includes a cylinder and piston providing for adjustability for the length of the connecting unit. The connecting unit will automatically fix its length after it has been put in place between a dock and boat, through a first tube having a valve device connecting its ends and two other tubes connecting each end to an inner location in said cylinder having a check valve preventing flow from each end to its inner location. The end of the connecting unit connected to the mooring structure provides for movement with the tide. When not in use the connecting unit can be placed in an upwardly extending position for availablity.

8 Claims, 4 Drawing Sheets

MOORING CONSTRUCTION FOR A BOAT

DESCRIPTION

1. Technical Field

This invention relates to a mooring construction for securing a boat to a dock, or spaced posts, to protect the boat from waves, wind, and changes in water level.

2. Background Art

Generally, boats are secured by ropes to docks and posts with fenders located to protect the sides of the boat. Patents which are known to relate to mooring devices are U.S. Pat. Nos. 2,808,016; 2,873,712; 3,492,963; 3,500,484; 4,066,030, 4,144,831; and 4,627,375.

3. Disclosure of Invention

It is an object of this invention to provide a mooring construction having a connecting unit for connecting a boat to a dock, or similar mooring structure, at three locations to control the positioning of the boat with the dock.

It is another object of this invention to provide a device for permitting the end of a connecting unit connected to the dock to rise and fall with the level of the water.

It is a further object of this invention to provide a connecting unit which has a variable length to accommodate different boat and dock configurations.

It is another object of this invention to provide a connecting unit having a cylinder and piston arrangement to provide for self-adjustment and provide damping after the boat has been attached.

It is another object of this invention to provide a mooring construction which is positioned for immediate use and which can be disconnected easily.

Other objects and features of the invention will become apparent in the detailed description of the invention, claims, and the following drawings.

DESCRIPTION OF THE PREFERRED EMBODIMENT

Figure 2:
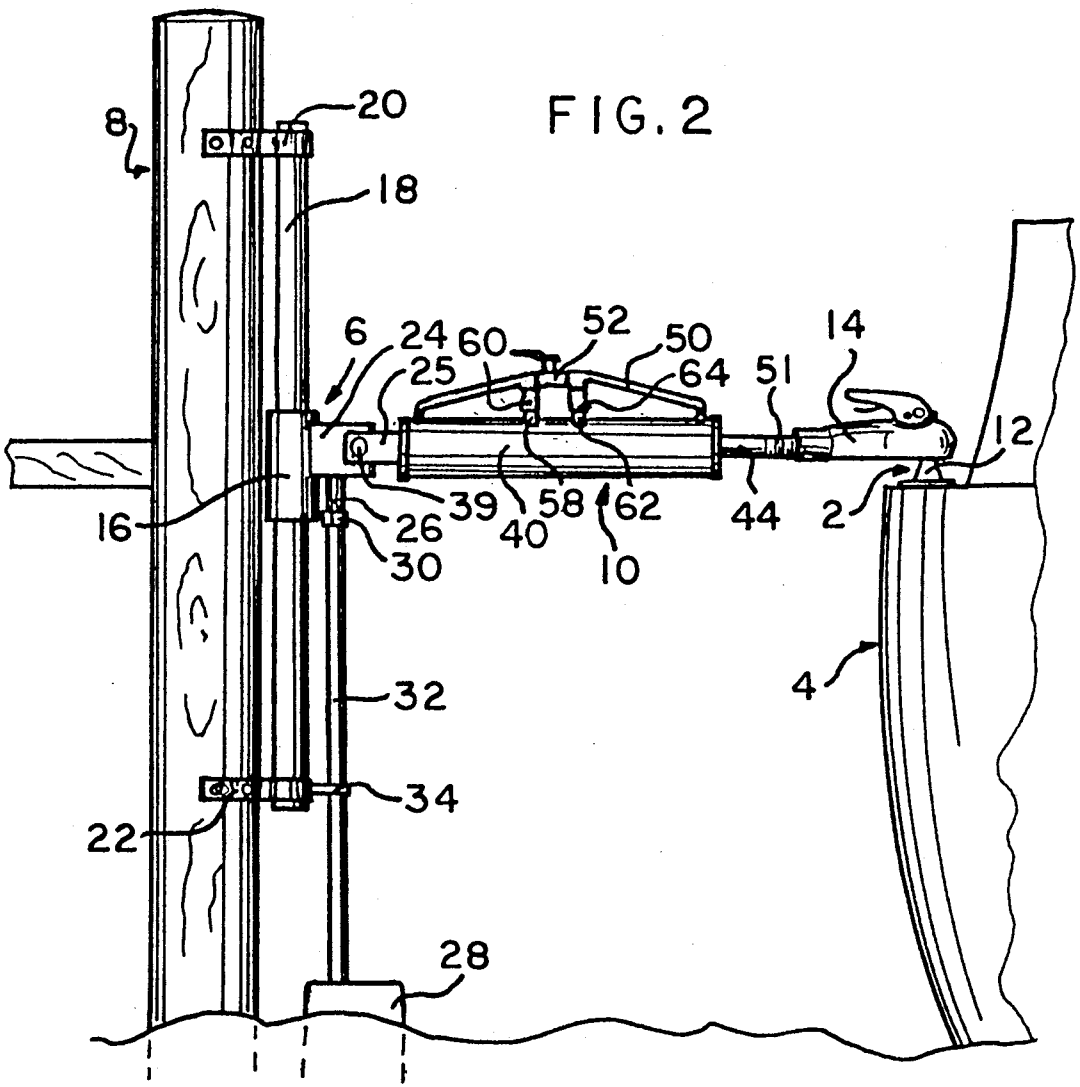
FIG. 2 is a side view of a connecting unit having one end pivotally connected to a boat by a spherical joint and the other end pivotally connected to a dock post by a slider device which maintains that end of the connecting unit a predetermined distance from the surface of the water.

This mooring construction, as shown in FIG. 2, comprises three main parts:

(1) a fixed mount member 2 mounted on a boat 4;

(2) a vertically movable slider device 6 mounted on a dock post 8., and (3) a connecting unit 10 connected between said fixed mount member 2 and said vertically movable slider device 6.

The fixed mount member 2 comprises a ball mounted on a base 12. A conventional ball hitch socket assembly 14 is located on one end of the connecting unit 10 to coact with the ball (such a connection is shown in U.S. Pat. No. 4,697,538). This permits this connection to have a quick connect-disconnect action and have means for locking the ball hitch socket assembly 14 on the ball while permitting spherical movement therebetween.

The vertically movable slider device 6 has a short tubular slider member 16 mounted on a longer cylindrical guide member 18 for relative sliding movement. The inside of the short tubular member 16 has a plastic bearing 17 to provide for an easier and quieter sliding motion. The cylindrical guide member 18 is fixedly mounted to a dock post, or other similar structure, by a top bracket 20 and bottom bracket 22. The brackets 20 and 22 are spaced apart to allow unrestricted movement of the slider device 6 for water level changes in the area.

A narrow flange member 24 extends outwardly from said vertically movable slider device 6 longitudinally along the upper part of short tubular slider member 16 to be pivotally connected within a bifurcated bracket, or fork, 25 on the other end of the connecting unit 10. While the flange member 24 is shown as U-shaped, it can be a single flat member. A short tubular member 26 extends downwardly from the bottom of said flange member 24 to be connected to a float member 28. The lower end of the short tubular member 26 has an enlarged portion 30 which is internally threaded to receive the externally threaded end of an elongated cylindrical member 32. The lower end of the elongated cylindrical member 32 is threadably secured to the float member 28. The elongated cylindrical member 32 can be fixed to the short tubular member 26 and float member 28 by any means desired. A guide ring 34 extends from the bottom bracket 22 to guide the elongated cylindrical member, or rod, 32. An opening 36 extends through each outwardly extending part of the U-shaped flange member 24 to receive a holding pin 38 for a purpose to be hereinafter described.

Figure 4:
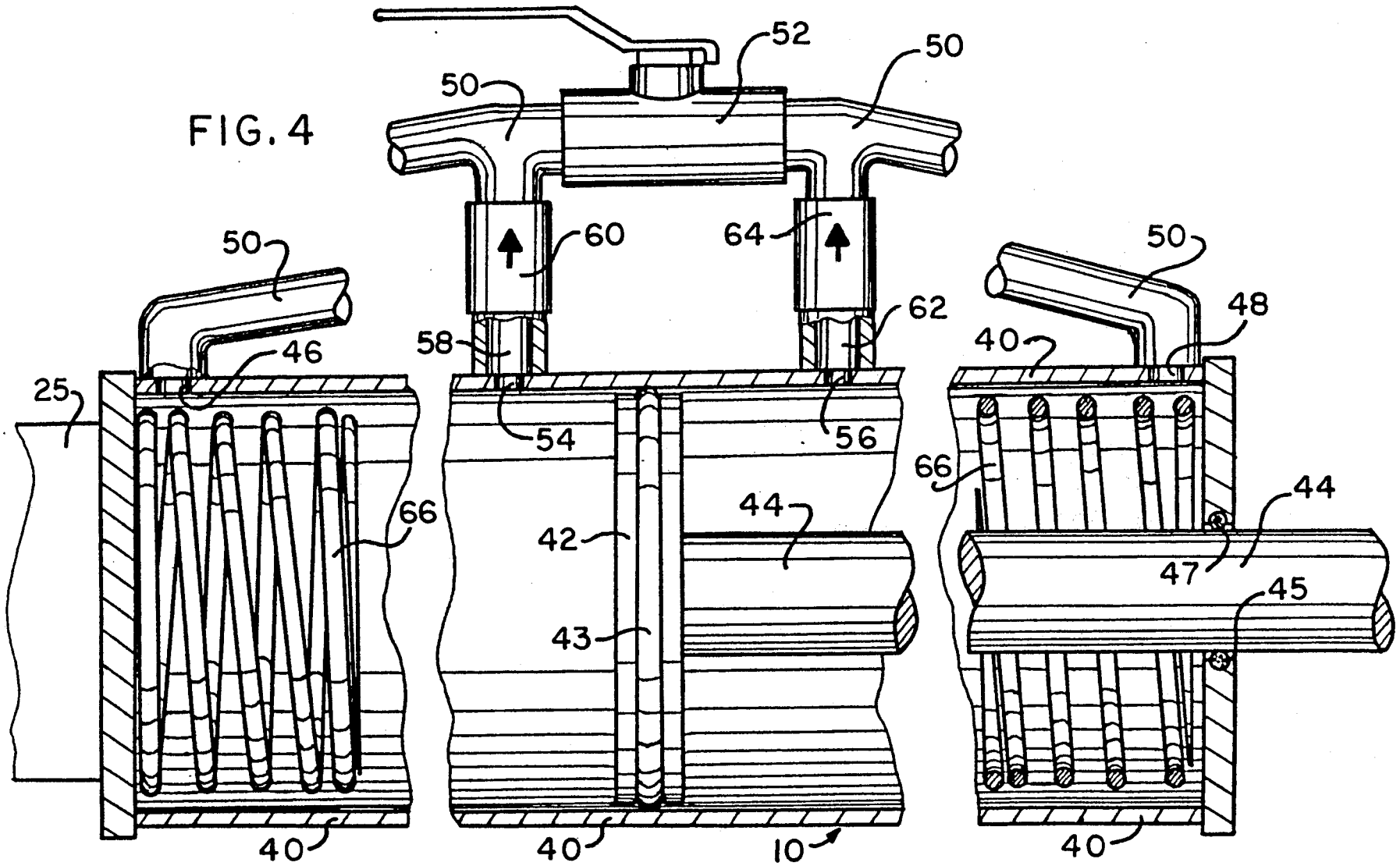
FIG. 4 is an enlarged fragmentary longitudinal sectional view of the cylinder of a connecting unit with external tubing.

As seen in FIG. 4, the connecting unit 10 comprises a cylinder 40 and piston 42 therein with a piston rod 44 fixed to said piston 42 and extending externally through an opening 45 in one end of the cylinder 40. An O-ring seal member 43 extends around the outer circumference of the piston 42 in a groove and contacts the interior surface of the cylinder 40. This seal member 43 provides an air tight seal between the chamber formed on each side of the piston 42 in the cylinder 40 as the piston 42 moves. An O-ring seal member 47 extends around the opening 45 in the one end of the cylinder 40 in a groove and contacts the exterior surface of the piston rod 44 passing therethrough. This seal member 47 provides an air tight seal between the interior and exterior of the cylinder 40. The other end of the cylinder 40 has the bifurcated bracket 25 extending therefrom. The end of the piston rod 44 extending to the exterior of the cylinder 40 has the ball hitch socket assembly 14 attached thereto. The end of the piston rod 44 has external threads 51 thereon which threadably engage internal threads in the mating end of ball hitch socket assembly 14. This threadable connection enables the length of the connecting unit 10 to be manually adjusted. With the length adjustment, a variation in the installation of the fixed mount members 2 changing the distance from the respective pivot points of the vertically movable slider devices 6 to the balls of the fixed mount members 2 can be compensated for. If necessary, the piston rod 44 can be extended with an extension member adapted to engage the threads 51.

Figure 8:
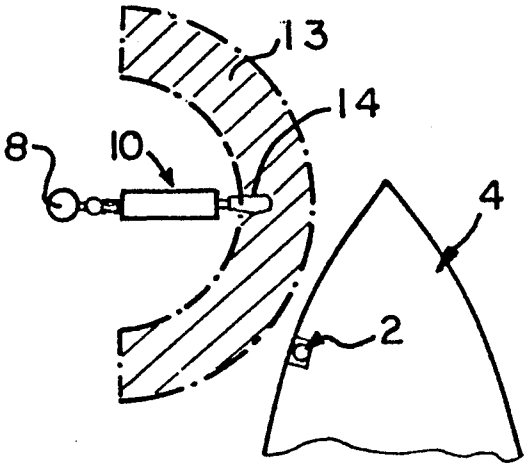
FIG. 8 is a top view of the bow of a boat and a connecting unit fixed to a post showing an arc sector where the ball on the boat must be placed so that the end of the connecting unit can be placed on the ball.

FIG. 8 shows the arc sector 13 in which the end of the ball hitch socket assembly 14 of connecting unit 10 can be positioned to be attached to a ball mounted on a base 12 comprising the fixed mount member 2.

An opening 37 extends through each tine of the bifurcated bracket 25 for alignment with openings 36 to receive the holding pin 38 as it passes through each opening 36 in the U-shaped flange member 24, thereby pivotally mounting the connecting unit 10 to the vertically movable slider device 6. The holding pin 38 has a round head 39 which is positioned on one outer side of one tine of the bifurcated bracket 25, while the holding pin 38 extends through to the outer side of the other tine of bifurcated bracket 25. The portion of the holding pin 38 extending through to the outer side has an opening 41 therethrough for receiving a locking pin 49 to fix the holding pin 38 in position. If theft is no problem, a bolt or large cotter pin can be used; for safety a padlock can be placed on said holding pin 38 with its shackle through the opening 41.

The interior of the cylinder 40 of the connecting unit 10 is interconnected by a system of tubes and valves. An opening 46 at one end of the cylinder 40 is connected to an opening 48 at the other end of the cylinder 40 by tube 50 having an "ON-OFF" valve 52 located at the center of the tube 50. It can be seen that the "ON-OFF" valve 52 controls the flow from one side of the piston 42 to the other side. With the "ON-OFF" valve 52 "ON", the piston 42 would be free to move from one end of the cylinder 40 to the other end, and with the "ON-OFF" valve 52 "OFF", the piston would be locked in place, providing damping. However, additional control is included in the connecting unit 10. Two openings 54 and 56 are provided in the side of the cylinder 40 at the center of the cylinder 40 at a small distance apart. Opening 54 is connected to the tube 50 between the opening 46 and "ON-OFF" valve 52 by a tube 58 and check valve 60. The opening 56 is connected to the tube 50 between the opening 48 and "ON-OFF" valve 52 by a tube 62 and check valve 64. Now, with the "ON-OFF" valve 52 "OFF", the check valve 60 only allows flow from opening 54 to opening 46 and the check valve 64 only allows flow from opening 56 to opening 48.

If the "ON-OFF" valve 52 is turned "OFF" when the piston 42 is at or between openings 54 and 56, the piston 42 and piston rod 44 is fixed in position with only damping movements occurring. If the "ON-OFF" valve 52 is turned "OFF" when the piston 42 is between opening 56 and 48, the piston 42 can only be moved toward the opening 56, by wave or other motion, until it reaches the opening 56 where it is then fixed in position with only damping movements occurring.

If the "ON-OFF" valve 52 is turned "OFF" when the piston 42 is between openings 54 and 46, the piston 42 can only be moved toward the opening 54, by wave or other motion, until it reaches the opening 54 where it is fixed in position with only damping movements occurring.

The openings 54 and 56 can be positioned at other locations to control the fixed length of a connecting unit 10. The openings 54 and 56 can be made one opening (not shown) connected to tubes 58 and 62 to provide a given length of connecting unit 10 regardless of what side the piston 42 was on when "ON-OFF" valve 52 was turned "OFF".

The float member 28 is formed as a plastic container filled with polyurethane expanded therein. This arrangement avoids the possibility of a leak as in a hollow float member. The float member 28 is sized to keep the end of the connecting unit 10 connected to the vertically movable slider device 6 above the water level at a position so that the other end of the connecting unit 10 can engage the fixed mount member 2 mounted on a boat 4. The cylinder 40 has a safety spring 66 therein on each side of the piston 42. The primary purpose of these springs 66 is to prevent the piston 42 from directly hitting the inner ends of the cylinder 40 in case of a malfunction, or heavy wave movement, when a connecting unit 10 is being connected and the "ON-OFF" valve has not been turned "OFF" yet.

Figure 1A:
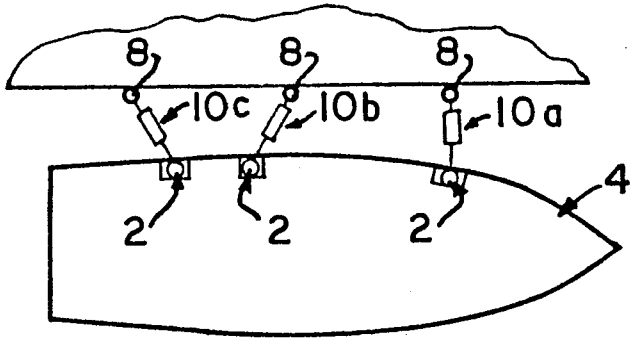
FIG. 1A is a schematic view showing one mooring arrangement of a boat with three dock posts with three connecting units between the dock posts and one side of the boat; one connecting unit for each dock post.
Figure 1B:
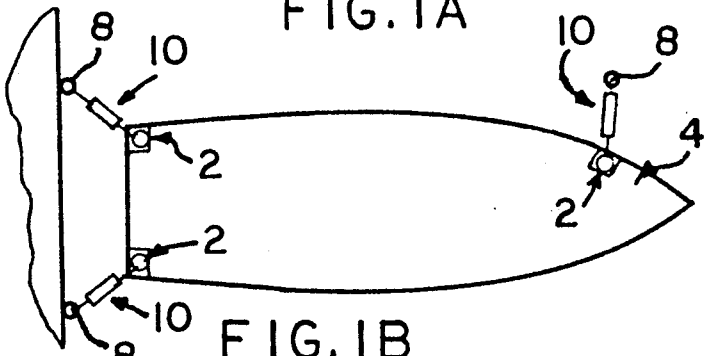
FIG. 1B is a schematic view showing another mooring arrangement of a boat with three dock posts with two connecting units between two dock posts and two spaced locations on the stern of the boat, and one connecting unit between a post and the bow of the boat.
Figure 1C:
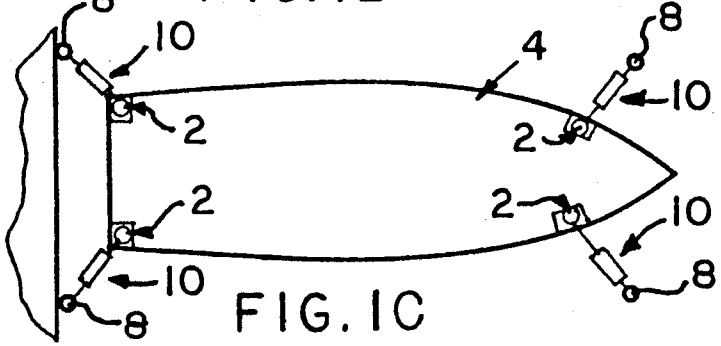
FIG. 1C is a schematic view showing another mooring arrangement of a boat with four posts with two connecting units between two dock posts and two spaced locations on the stern of the boat, one connecting unit between a post and one side of the bow of the boat, and another connecting unit between a post and the other side of the bow of the boat.
Figure 1D:
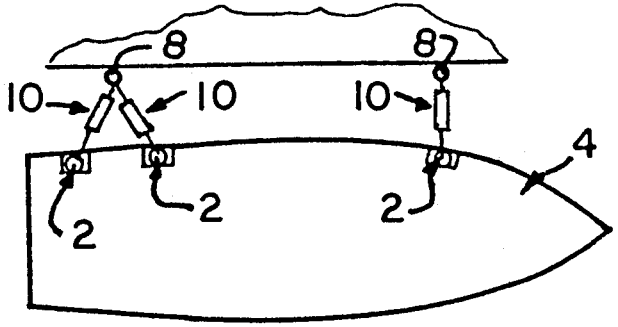
FIG. 1D is a schematic view showing another mooring arrangement of a boat with two dock posts with three connecting units between the dock posts and one side of the boat, two connecting units for one dock post positioned at an angle to each other and one connecting unit for one dock post.

FIGS. 1A through 1D show different applications for the mooring of a boat or other nautical vessel. The basic mooring is shown in FIG. 1A where three (3) variable length self-adjustable connecting units 10*a*, 10*b* and 10*c* have been placed between mount members 2 on the boat or other nautical vessel, 4, and dock posts, or other posts, 8. One of the variable length, self-adjustable connecting units 10*a* has been placed perpendicularly from one post 8 on a dock and one mount member 2 on the boat 4 and the other two (2) connecting units 10*b* and 10*c* are positioned at opposite angles to each other between mount members 2 on the boat 4 and two (2) other posts 8; said angles being at least 30° angles when compared to the perpendicular connecting unit 10*a*. The preferred angle is a 45° angle. These three (3) connecting units with three (3) different angles (see FIG. 1A) will result in a stable mooring that will retain the boat 4 in place because of the connecting units 10 and the fixed mount members 2. FIG. 1B shows one mooring where the dock posts 8 are in a triangular shape and FIG. 1C shows one mooring where the dock posts 8 are in a rectangular shape. FIG. 1D shows one mooring where there are two dock posts 8 with two connecting units 10 being connected to one post 8.

Figure 3:
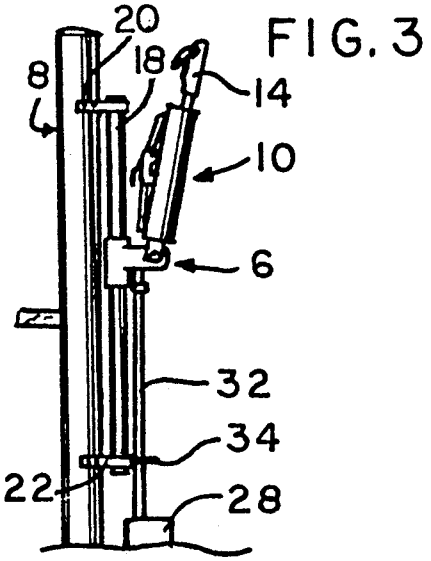
FIG. 3 is a side view showing the connecting unit of FIG. 2 pivoted upwardly about its slider device in position to use for securing a boat to a dock.
Figure 7:
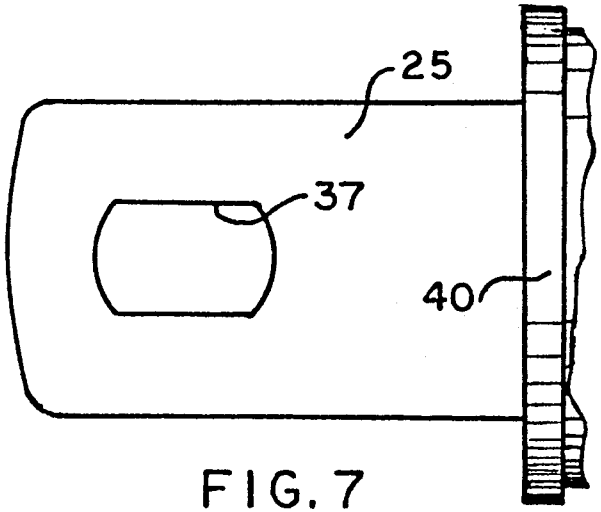
FIG. 7 is an enlarged side view of the bifurcated bracket extending from one end of the connecting unit for connection to the slider device.
Figure 5:
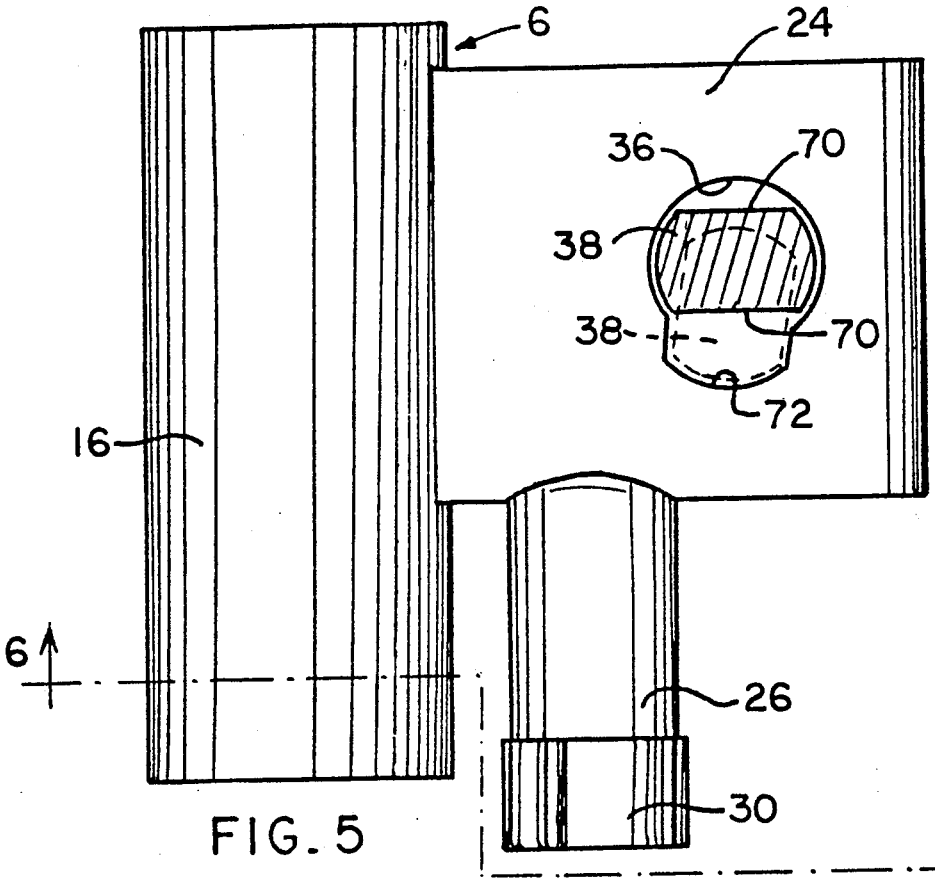
FIG. 5 is an enlarged side view of the slider device which can move vertically on a guide member fixed to a dock post showing a cross-section of a connecting pin.
Figure 6:
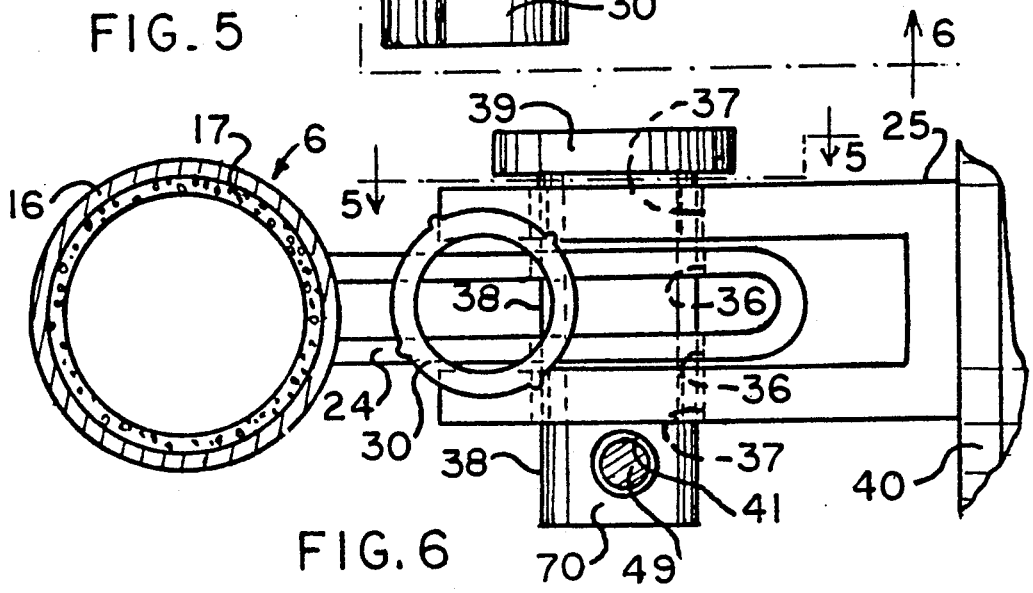
FIG. 6 is a view taken on the line 6—6 of FIG. 5 showing the one end of a connecting unit connected to the slider device by a connecting pin.

To position a connecting unit 10 as shown in FIG. 3, the holding pin 38 is formed having a like flat surface 70 on diametrically opposed sides which fit into similarly shaped holes 37 in each tine of the bifurcated bracket 25; this fixes their movement together. The holes 36 of the U-shaped flange member are shaped round to accommodate the full diameter of the holding pin 38. A contoured notch 72 is formed in the lower surface of each hole 36 at a slight angle inwardly to receive the width of the holding pin 38 between the sides 70. When the connecting unit 10 is moved to the position shown in FIG. 3, the holding pin 38 drops into the notch 72 to hold the connecting unit 10 as shown (see the holding pin in phantom in FIG. 5).

In case the tide provides a difference in water level of three (3) meters or more, the cylindrical guide member 18 can be made rectangular in shape and the tubular slider member 16 can be made of a mating rectangular shape. This long rectangular guide member could be supported at intermediate places along its length between brackets 20 and 22 by other fixed brackets having an arm extending from a post 8 to the long rectangular guide member. The rectangular shaped slider member could have a slot opening along its length adjacent the post 8 to accommodate one extending arm or more, if necessary, permitting up and down movement of the rectangular shaped slider member on the long rectangular guide member.

It will be obvious that the foregoing description and illustrations have been presented for the preferred form of this invention; however, it is not intended to limit the invention to the precise form disclosed. Furthermore, modifications and variations are possible in view of explanations presented. It is therefore intended that the scope of the invention be defined by the appended claims.

What is claimed is:

1. A boat mooring construction for connecting a boat to a mooring location, a connecting unit having an attachment means on each end, said connecting unit comprising a cylinder having two ends, a piston mounted for movement in said cylinder, a piston rod connected to said piston, an opening in one end of said cylinder, said piston rod extending through said opening to a free end exterior of said cylinder, one attachment means being connected to the piston rod, the other attachment means being connected to the other end of the cylinder, first conduit means connecting one end of the cylinder to the other end, a valve means located in said first conduit means to control flow therethrough from one end of the cylinder to the other by allowing flow or preventing flow, second conduit means connecting said one end of the cylinder to a first location at an inner portion of the cylinder, third conduit means connecting said other end of the cylinder to a second location at an inner portion of the cylinder, a first check valve located in said second conduit means to permit flow only from said first location to the one end of the cylinder, and a second check valve located in said third conduit means to permit flow only from said first location to the other end of the cylinder.

2. A combination as set forth in claim 1 wherein said second conduit means connects said first conduit means on one side of said valve means to said first location, and said third conduit means connects said first conduit means on the other side of said valve means to said second location.

3. A combination as set forth in claim 1 wherein said second location is at said first location.

4. A combination as set forth in claim 1 wherein said second location is spaced from said first location.

5. A combination as set forth in claim 1 wherein a spring means is located in one end of said cylinder around said piston rod to prevent damage to said cylinder when said valve means is open.

6. A combination as set forth in claim 5 wherein a second spring means is located in the other end of said cylinder.

7. A combination as set forth in claim 1 wherein said valve means is an "ON-OFF" valve, when said valve means is "ON" allowing flow therethrough said connecting unit is freely movable between its extended position and its retracted position.

8. A combination as set forth in claim 7 when said valve means is "OFF" preventing flow therethrough, movement of the piston is controlled by flow through the second conduit means.

* * * * *